US007861653B2

(12) United States Patent
Dylla et al.

(10) Patent No.: US 7,861,653 B2
(45) Date of Patent: Jan. 4, 2011

(54) ROLLS AND CYLINDERS WITH A STEEL CORE FOR OFFSET PRESSES

(75) Inventors: Norbert Dylla, Stadtbergen (DE); Eduard Hoffmann, Bobingen (DE); Stefan Albrecht, Neusäss (DE)

(73) Assignee: manroland AG, Offenbach am Main (DE)

( * ) Notice: Subject to any disclaimer, the term of this patent is extended or adjusted under 35 U.S.C. 154(b) by 66 days.

(21) Appl. No.: 11/087,253

(22) Filed: Mar. 23, 2005

(65) Prior Publication Data

US 2005/0217522 A1 Oct. 6, 2005

(30) Foreign Application Priority Data

Mar. 24, 2004 (DE) ..... 10 2004 014 308

(51) Int. Cl.
*B41F 13/10* (2006.01)

(52) U.S. Cl. ..... 101/375; 101/368

(58) Field of Classification Search ..... 101/375, 101/368

See application file for complete search history.

(56) References Cited

U.S. PATENT DOCUMENTS 1,955,673 A * 4/1934 Fawdry ..... 101/415.1
2,324,631 A * 7/1943 May ..... 101/475
2,627,228 A * 2/1953 Bromley ..... 101/375
3,447,674 A * 6/1969 Fraser ..... 242/160.1
3,926,116 A * 12/1975 Wildeman ..... 101/148
4,022,125 A * 5/1977 Weaver ..... 101/148
4,503,769 A * 3/1985 Andersen ..... 101/153
5,047,808 A * 9/1991 Landa et al. ..... 399/308
5,084,716 A * 1/1992 Koumura et al. ..... 346/140.1
5,468,568 A * 11/1995 Kuhn et al. ..... 428/35.9
5,813,334 A * 9/1998 Blanchard ..... 101/217
5,957,052 A * 9/1999 Endisch et al. ..... 101/375
6,401,614 B1 * 6/2002 Venturati ..... 101/375
6,567,641 B1 * 5/2003 Aslam et al. ..... 399/330
6,640,705 B1 * 11/2003 Stuhlmiller et al. ..... 101/217

FOREIGN PATENT DOCUMENTS

DE 502022 7/1930
GB 1156582 * 7/1969
GB 2089473 A 6/1982
JP 02095855 A 4/1990

OTHER PUBLICATIONS

Search report in counterpart European Patent Application No. 05006060.7-1251.

* cited by examiner

*Primary Examiner*—Anthony H. Nguyen
(74) *Attorney, Agent, or Firm*—Leydig, Voit & Mayer, Ltd.

(57) ABSTRACT

A cylinder for an offset printing press comprising a steel core and a heat-conducting layer arranged on the steel core in order to uniformly distribute localized steel core heating. The heat can consist of copper and can be arranged in or underneath a functional layer on the cylinder.

8 Claims, 2 Drawing Sheets

ROLLS AND CYLINDERS WITH A STEEL CORE FOR OFFSET PRESSES

FIELD OF THE INVENTION

The invention relates to rolls and/or cylinders with a steel core, in particular for transferring ink in offset presses.

BACKGROUND OF THE INVENTION

In presses, rolls are used in inking and damping units. Rolls normally comprise a roll core, for example in the form of a steel tube, and a functional layer on the steel tube. This functional layer can be a resilient rubber layer, a plastic layer with good ink transfer properties or ceramic or metallic layers with specific properties, such as hydrophilicity or wear resistance. Moreover, in offset presses, transfer cylinders (what are known as offset cylinders) are needed with which the images to be printed are picked up from an inked form cylinder in order to be applied to a printing material in contact with the transfer cylinder. Transfer cylinders of this type are normally called rubber-covered cylinders.

These rubber-covered cylinders likewise comprise a metallic cylinder core. This cylinder core can consist of steel and can be completely cylindrical or, in particular when rubber-coated sleeves are used, can be a hollow cylinder (i.e., also a metallic tubular cylindrical rotational body). A hollow cylinder can also be filled with a "foam" material.

At high printing speeds (e.g., high press rotational speeds of above 50,000 or even 70,000 revolutions/hour), heating becomes an issue, in particular in the rubber-covered cylinders in offset presses, and has very detrimental consequences. This heating is often non-uniform and leads to thermal expansions. These thermal expansions are exhibited as a deflection of the cylinder that is particularly caused by the temperature difference in the cross-section of the cylinder or the roll.

The deflections, which can be in the form of banana-like bulging of the rolls or cylinders, can lead to problems in the media transfer, for example during the transfer of the image to be printed from a rubber-covered cylinder to a printing material. The cause of non-uniform heating in the cylinder or the roll can lie in deviations from a circular shape or imbalances of the roll, which can never be completely avoided in the fabrication process. This effect is particularly noticeable in presses with very narrow rolls or cylinders and a relatively great length (i.e., press width). High rotational speeds exacerbate this effect.

In order to avoid this effect and its consequences, the rolls or cylinders previously have been cooled. To this end, liquid cooling media, water in the simplest case, had to be led through the cylinder through corresponding bores or tubular guides. The aforementioned problems can be partially eliminated via cooling. Cooling achieves an overall reduction in the temperature in the roll or the cylinder. However, local temperature differences cannot be completely avoided even with such a temperature reduction and ultimately could lead to the aforementioned problems. In addition, roll or cylinder cooling is complicated in design terms and is relatively costly.

Producing cylinders or rolls or roll cores from invar steel or from CRP is also already known. These materials exhibit very low or no thermal expansions, but are very expensive and, to some extent, cannot be easily coated with the typical functional layers.

In addition, the non-uniform heating in the rolls and cylinders can also depend on the particular use for the roll or cylinder. In particular, the distribution of ink and water on the cylinder surfaces play a part.

BRIEF SUMMARY OF THE INVENTION

In view of the foregoing, a general object of the present invention is to provide a roll or cylinder for an offset press that avoids the effects of non-uniform heating without the use of expensive materials or cooling systems. According to the invention, this is achieved by provided a heat-conducting layer over the steel core of the cylinder or roll in order to distribute the localized steel core heating. Such heating can occur during printing operations or when the machine is at a standstill, as a result of heat flow from adjacent components.

The invention will be described in detail in the following text using exemplary embodiments.

DETAILED DESCRIPTION OF THE INVENTION

Figure 1:
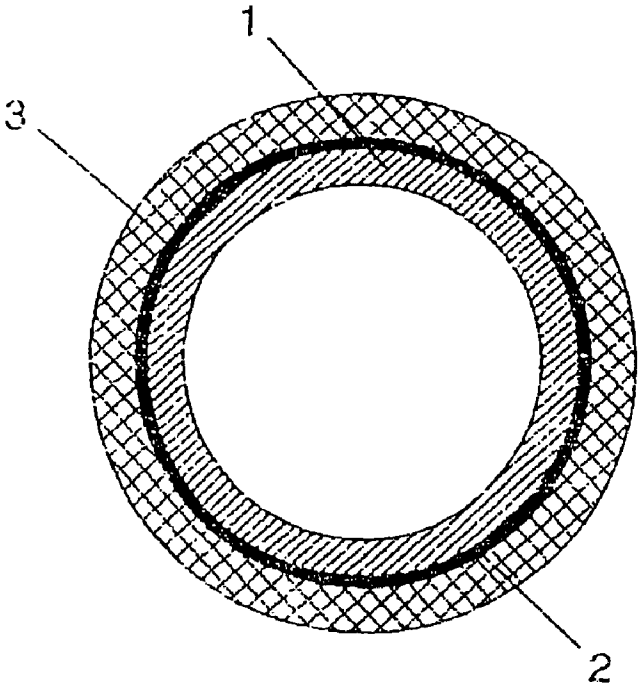
FIG. 1 is a schematic cross-sectional view of an exemplary blanket or sleeve for a rubber-covered cylinder of an offset press having a heat conducting layer according to the present invention.

FIG. 1 provides a schematic illustration of what is known as a rubber blanket or sleeve that can be pushed axially onto the transfer roll or cylinder—usually called a rubber-covered cylinder—of an offset press. The terms "cylinder(s)" and "roll(s)" are used herein interchangeably such that the term cylinder also includes rolls and the term roll also includes rolls. The terms "blanket" and "sleeve" are also used interchangeably herein. An inner supporting sleeve 1 made of nickel or CRP can be widened by air flowing out of the transfer cylinder, so that the rubber blanket or sleeve can be pushed on and, after the air supply has been switched off, fixed to the cylinder.

As explained above, the cylinders are normally made of steel and have either a tubular construction or consist of a solid material. Cylinder steel cores of this type have relatively unfavorable thermal conductivity, which leads to the aforementioned localized heating problems. In this case, the thermal conductivity of the steel used for the production of the cylinders, which is of the order of about 50 W/mK, will be assumed as an unfavorable or poor. Due to the unfavorable thermal conductivity of the steel cylinder, undesired deformation results from the non-uniform distribution of heat in the cylinder material.

According to the present invention, the non-uniform, undesired heating that causes these problems can be eliminated by providing a thermally conductive material or layer on the cylinder or roll that produces a more uniform thermal distribution. Such a thermally conductive layer can also be provided on or in the rubber sleeves that are used on rubber-covered cylinders in offset presses. The highly thermally conductive material can be copper, which has a thermal conductivity of about 400 W/mK. It is also possible to use alloys or mixtures with a high proportion of copper. In comparison, the rubber blanket used in the rubber-covered cylinders has a thermal conductivity of about 0.1 W/mK. These values illustrate how the heating of rolls or cylinders can be made more uniform according to the present invention through the use of a layer of copper or another material that has a thermal conductivity substantially above the conductivity of the steel.

The preferred copper layer offers particular advantages at a thickness between 1 and 5 mm. According to one preferred embodiment, a thickness of 2 mm can be used. The copper layer can be embodied as a copper sleeve on a rubber sleeve in a rotary offset press or as layers with the desired thickness directly on the cylinder or sleeve. The copper layer also can be arranged in the sleeve or in the rubber blanket or its layer structure. It is particularly advantageous to provide copper layer layers on and in rolls, in particular film rolls and ink fountain rolls in presses.

Thus, the heat-conducting layer of the present invention can be incorporated on or underneath the surface of the cylinder, roll or sleeve. For example, it can be embodied as a thermally conductive film or a heat-conducting fabric within the visco-elastic coverings, printing blankets, printing plates and sleeves that, in the offset process, substantially cause the production of heat.

The heat-conducting layer of the present invention can economically and advantageously be sprayed onto the cylinder or roll body, or applied by electroplating processes. The thickness of the heat-conducting layer depends on the magnitude or the volume of the heat to be distributed. The heat-conducting layer of the invention has virtually no influence on the stiffness of the cylinders or the rolls. In addition, only slight additional costs arise in the production of the rolls and cylinders or sleeves.

FIG. 1 schematically illustrates a rubber sleeve for an offset cylinder of a press, which, for example, can comprise a nickel sleeve 1 on which the heat conductive layer 2 of the invention can be fixed directly. A functional layer, in this case a rubber layer 3, is provided on the heat-conducting layer 2. The rubber layer 3 normally comprises a plurality of layers of different composition.

Figure 2:
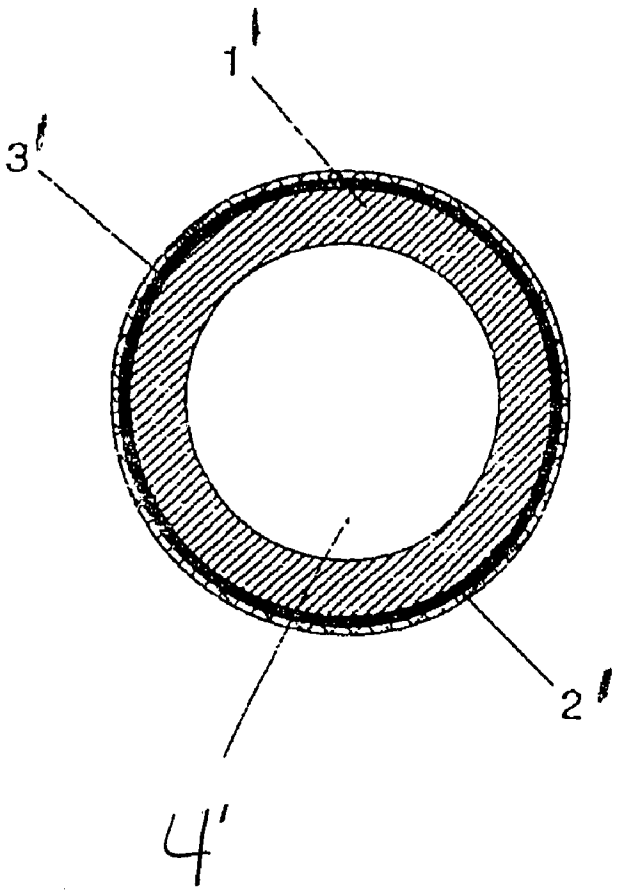
FIG. 2 is a schematic cross-sectional of an exemplary roll for use in inking or damping units of offset presses having a heat conducting layer according to the present invention.

FIG. 2 schematically illustrates a roll 4' such as can likewise be used in offset presses. The roll comprises a steel tube 1' on which a conductive layer 2' is arranged directly. A functional layer 3', for example a plastic layer of Rilsan can then be applied to the conductive layer 2'.

Figure 3:
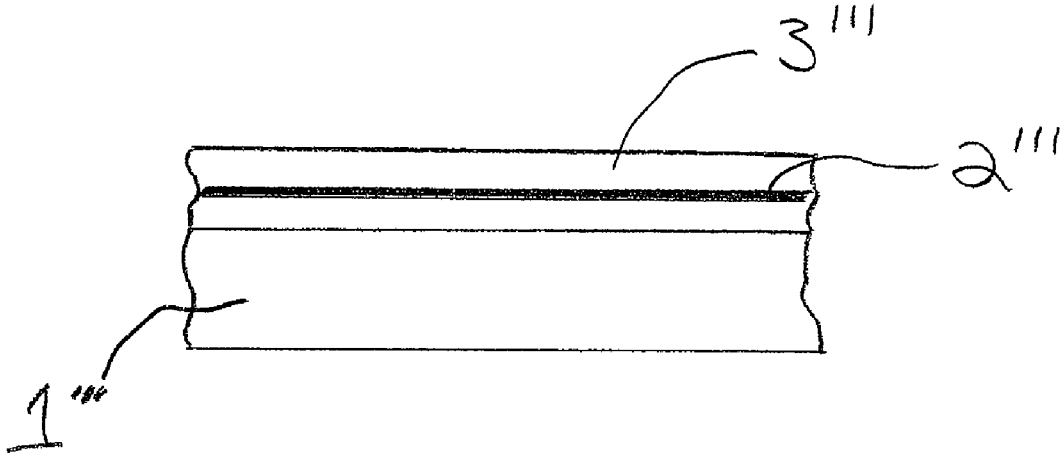
FIG. 3 is a schematic cross-sectional view of an alternative embodiment of a cylinder with a heat conducting layer according to the present invention.

FIG. 3 schematically illustrates a cylinder including a steel core 3''' with a rubber blanket 3''' arranged on the steel core. The heat conductive layer 2''' is arranged in the rubber blanket 3''' or its layer structure.

What is claimed is:

1. A cylinder for an offset printing press comprising a steel core, one or more rubber blankets arranged on the steel core, and a solid heat-conducting layer comprising a solid copper sleeve arranged internally of at least one of the one or more rubber blankets in order to uniformly distribute localized steel core heating wherein the copper sleeve of the heat conductive layer has a thickness of between approximately 1 mm and approximately 5 mm and has a thermal conductivity approximately eight times higher than a thermal conductivity of the steel core.

2. The cylinder according to claim 1, wherein the copper sleeve has a thickness of approximately 2 mm.

3. The cylinder according to claim 1 wherein the cylinder is an offset transfer cylinder.

4. The cylinder according to claim 1, wherein the one or more rubber blankets includes a non-rubber supporting sleeve with a rubber layer structure arranged on the supporting sleeve and the heat-conducting layer is arranged on the supporting sleeve.

5. The cylinder according to claim 1, wherein the rubber blanket includes a non-rubber supporting sleeve with a rubber layer structure arranged on the supporting sleeve and the heat-conducting layer is arranged in the rubber layer structure.

6. The cylinder according to claim 1, wherein the cylinder is a roll in an inking unit of an offset press.

7. The cylinder according to claim 1, wherein the steel core has a tubular configuration.

8. The cylinder according to claim 1, wherein the steel core is a solid cylinder.

* * * * *